US006343790B1

(12) United States Patent
Rhemm

(10) Patent No.: US 6,343,790 B1
(45) **Date of Patent: *Feb. 5, 2002**

(54) METHOD AND APPARATUS FOR INVERTING USED BOARD GAME PIECES AND ACCOUNTING THEREFOR

(76) Inventor: Ferguson Rhemm, 2005 S. Spaulding Ave., Los Angeles, CA (US) 90016

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/859,789

(22) Filed: May 19, 1997

Related U.S. Application Data

(60) Provisional application No. 60/018,223, filed on May 23, 1996.

(51) Int. Cl.[7] ..... A63F 3/00

(52) U.S. Cl. ..... 273/287; 273/272; 273/148 R

(58) Field of Search ..... 273/272, 287, 273/273, 292, 299, 309, 148 R, 280

(56) References Cited

U.S. PATENT DOCUMENTS

| | | | | |
|---|---|---|---|---|
| 526,908 | A | * 10/1894 | Parker | 273/387 |
| 3,794,327 | A | * 2/1974 | Washington | 273/287 |
| 4,436,307 | A | * 3/1984 | Caldwell | 273/157 R |
| 4,466,515 | A | * 8/1984 | D'Aurora et al. | 273/280 |
| 4,591,161 | A | * 5/1986 | Vanderhoof | 273/280 |
| 4,705,275 | A | * 11/1987 | Slater | 273/309 |
| 4,875,688 | A | * 10/1989 | Whaley | 273/287 |

* cited by examiner

*Primary Examiner*—William M. Pierce
(74) *Attorney, Agent, or Firm*—Christie, Parker & Hale, LLP

(57) ABSTRACT

An apparatus for collecting a game pieces such as tiles from a game board. The apparatus includes a cover sized to fit over the game board and a collection tray. The cover has a collection surface for collecting the game pieces and depending sides along its perimeter, one of which includes a cut-out portion with a lip flush with the collection surface. The raised edge of the tray is also flush with the collection surface of the cover. Players pass the games pieces on the collection surface through the opening and onto the tray for reuse or storage.

13 Claims, 4 Drawing Sheets

METHOD AND APPARATUS FOR INVERTING USED BOARD GAME PIECES AND ACCOUNTING THEREFOR

CROSS-REFERENCE TO RELATED APPLICATIONS

This application claims the benefit of U.S. Provisional Application Ser. No. 60/018,223, filed May 23, 1996, the disclosure of which is hereby incorporated by reference.

FIELD OF THE INVENTION

The present invention relates generally to devices to assist players of board games employing multiple pieces, such as tiles, requiring inverting and collection of game pieces at the completion of play. More particularly, the invention relates to an apparatus having a cover adapted for placement over the game board which, upon inversion of the game board and cover, collects the game pieces or tiles which are then swept onto a collection tray for visual accounting prior to reuse in the next game.

BACKGROUND OF THE INVENTION

Numerous board games which exist which employ playing pieces or tiles which are placed on the board to form patterns, words or sequences in varying order. Typically, the games involve numerous pieces which are consecutively placed on the board by various players during progress of the game. At the conclusion of the game, the tiles must be collected and either sorted or, more typically, shuffled and allocated to players for the next game.

Previously, inverting and accounting for the used pieces or tiles involved collecting the tiles from the board one-by-one, or tipping the board to allow the game pieces to slide off in a jumble and placed face down uniformly near the game board or perhaps tumbled into a plastic pouch for player extraction and replay.

It is therefore desirable to have an apparatus and method for inverting game pieces from a board subsequent to a game and placing the pieces on a portable tray or other surface ready for replay.

It is also desirable that safe storage of the tiles or pieces be accommodated between games to avoid loss of the tiles.

SUMMARY OF THE INVENTION

The present invention is applicable to board games having various geometries for the board and pieces or tiles. For ease of description, a game having a substantially square board with substantially square flat tiles will be assumed for the exemplary embodiment. The apparatus of the invention includes a first cover having a top with depending sides adapted for placement over the board with tiles in place on the board subsequent to a game. The depending sides extend over the edges of the board in closely spaced relation. Once the cover is inserted over the board, the combined cover and board are inverted allowing the tiles to be supported by the inner surface of the cover. The game board is then removed slowing the tiles to remain in the cover, face down.

Subsequent to removal of the game board, the tiles are flat and inverted. An elongated cutout is provided as a portion of one of the depending sides on the cover. The cutout extends substantially to the inner surface of the cover on which the tiles rest after inversion. A collection tray having at least one flat side is abutted to the cover adjacent the cutout and tiles are transferred from the cover to the tray by sliding or sweeping the tiles through the cutout onto the surface of the tray. The typically arbitrary nature of sliding or sweeping the tiles from their position, as the cover was inverted, onto the tray effectively scrambles the tiles. The inverted position of the tiles prevents players from seeing the designation or enumeration on the face of the tiles while the tiles are quickly pushed or pulled onto the tray with the players' fingers.

The collection tray incorporates sides which are slightly elevated from the collection surface to restrain the tiles received on the tray. Once all tiles have been dispersed from the cover onto the tray, secrecy of selection of game pieces is guaranteed as play resumes. Accounting for all tiles between games is accomplished by sweeping the tiles in segregated groups to the edges of the collection tray. A divider of predetermined size is then placed between the tiles which have been segregated to the sides. A missing tile is easily seen if uneven groups of tiles exist. Relative sizing of the tray and divider is established based on the tile sizes and configurations for which the invention is employed.

The tiles are then taken from the tray covertly by the players in turn, and positioned in a rack discretely positioned or held privately.

The apparatus and method of the invention will be more clearly understood with reference to the following drawings and detailed description.

DETAILED DESCRIPTION OF THE INVENTION

Figure 1:
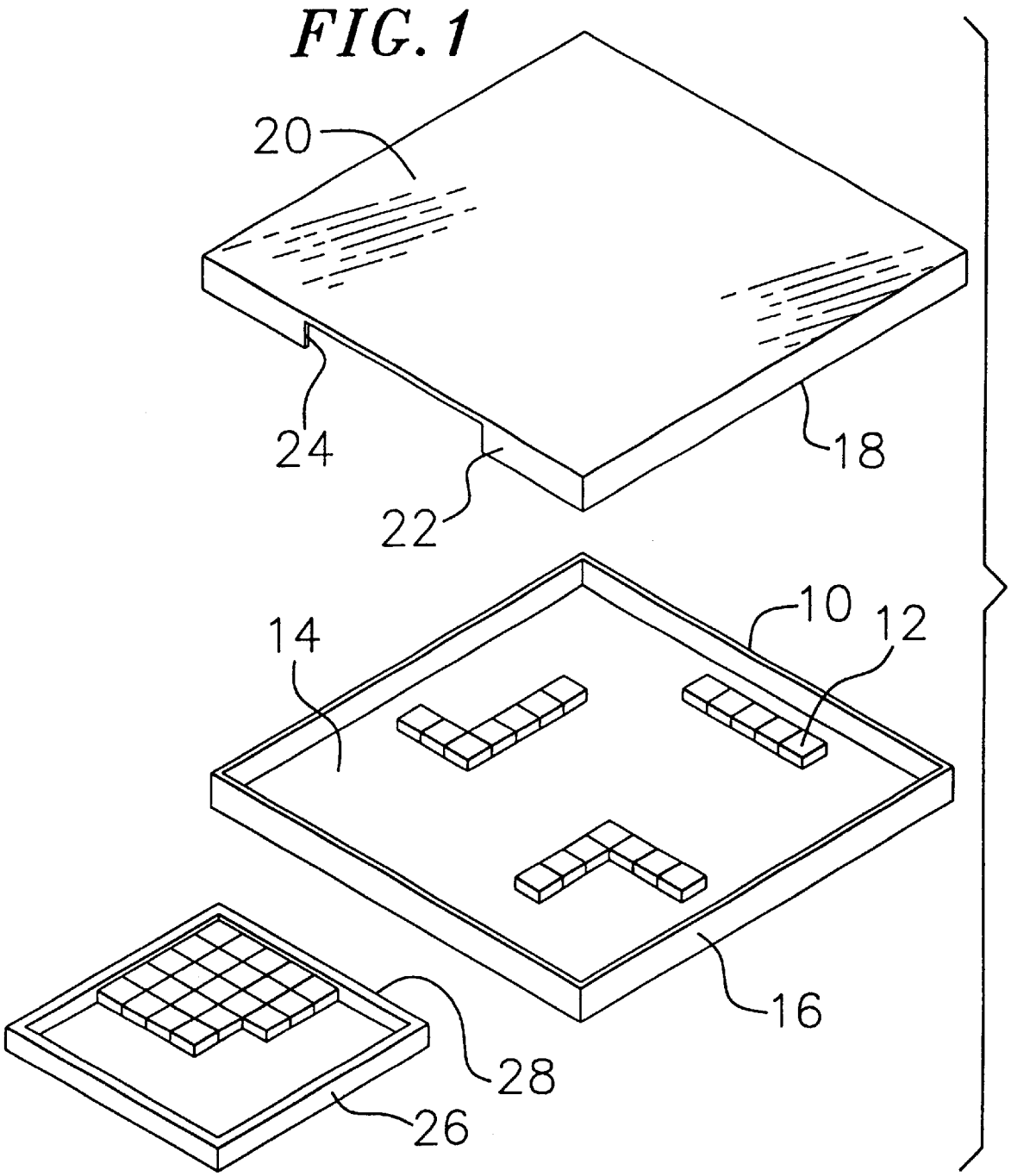
FIG. 1 is an exploded pictorial view showing an exemplary game board with tiles in place and relative positioning of the cover for placement over the board and the associated tile collection tray.

Referring to the drawings, FIG. 1 demonstrates an exemplary embodiment of the invention for use with a substantially square game board 10 having game tiles 12 which are substantially rectangular with a height dimension substantially less than the side dimensions of the tile. During game play, individual tiles are arranged on the surface 14 of the game board in patterns or lines. Exemplary of games of this type would be Scrabble® originated by Milton Bradley. The game board shown includes sides 16 which include a raised edge extending above the game playing surface.

The first element of the apparatus of the present invention is a cover 18 which incorporates a top 20 and depending sides 22. The cover is sized for placement over a specific game board with depending sides 22 extending over sides 16 of the game board in close engagement. At least one side of the cover incorporates a cutout portion 24 which will be described in greater detail subsequently.

A second element of the apparatus of the present invention is a collection tray 26 which incorporates raised edges 28 to retain game tiles in the tray.

Figure 2:
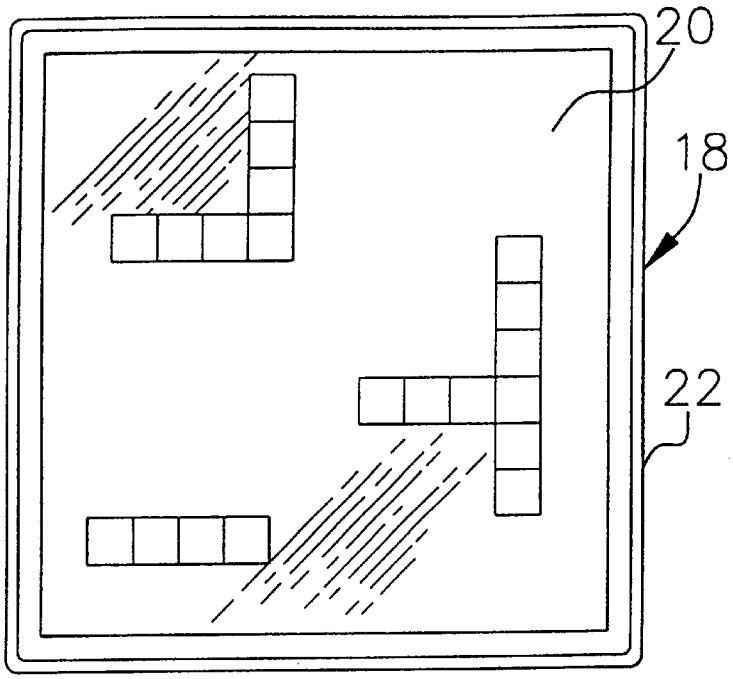
FIG. 2 is a top view of the game board with the cover of the present invention placed thereon.

FIG. 2 is a top view of the game board with an exemplary clear plastic embodiment of the cover of the present invention placed over the board. The embodiment shown employing in clear plastic allows viewing of the game pieces present on the board through the cover.

Figure 3:
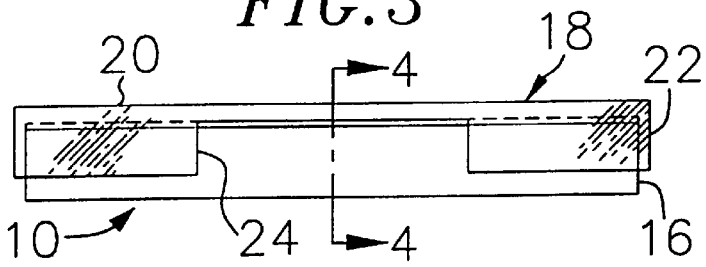
FIG. 3 is a front elevation view of the game board with the cover installed and showing the cutout portion of the first depending side.

FIG. 3 shows the close engagement of the sides 22 of the cover with sides 16 of the game board. The cutout portion of the depending side of the cover shown in the front view of FIG. 3 is apparent.

The method of the present invention employing the apparatus as described is accomplished by placing the cover on the game board as shown in FIGS. 2 and 3 followed by inverting the game board and cover as a unit. The game board is then removed from the cover leaving the game tiles on a collection surface 30 of the top of the cover as shown in the sectional view of FIG. 4 the game tiles remain inverted on the collection surface. Using their fingers, game players push or pull the tiles, sweeping the tiles along the collection surface of the cover through the cutout portion 24 onto the collection tray 26. The collection surface of the cover is substantially even with a lip 32 of the cutout portion which is in turn substantially even with the extending edge 28 of collection tray 26 when abutted to the cover. This relative dimensioning of the elements of the cover and collection tray allows the tiles to be swept from the collection surface onto the collection tray with minimal resistance thereby reducing the likelihood of inadvertently inverting the tiles.

Figure 4:
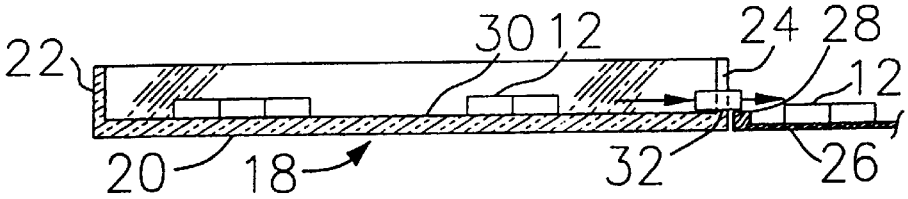
FIG. 4 is a side sectional elevation, along lines 4—4 of FIG. 3, showing placement of the tiles on the inner surface of the cover after inversion and removal of the game board, and demonstrating the method for sweeping the tiles from the cover onto the collection tray.
Figure 5:
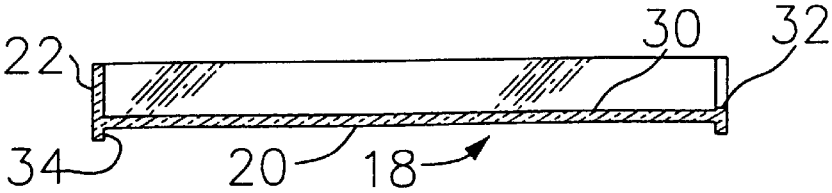
FIG. 5 is a side sectional view of a second embodiment of the cover wherein the thickness of the walls and top of the cover are substantially the same and the cover top is recessed to provide substantial alignment with the tile collection surface through the cutout to the lip of a collection tray to assure easy sweeping of tiles from the cover onto the tray.

In the embodiment shown in FIG. 4, the top 20 of the cover has a substantial thickness to achieve alignment of the collection surface, lip of the cutout portion and elevated edge of the collection tray. To reduce the thickness of the top of a cover to a dimension comparable with the sides of the cover, an alternative embodiment for the cover is shown in FIG. 5. The top of the cover is indented from the edges to provide alignment of the collection surface with the lip of the cutout portion while maintaining a reduced thickness for the top of the cover. The indentation is provided by ridges 34 which extend normally from at least two opposed edges of a surface of top 20 which is opposite collection surface 30. This embodiment of the cover, with an indented top, provides the additional benefit of an elevated edge when placed on the game board within which collection trays may be placed for storage or ease of transportability.

Figure 6:
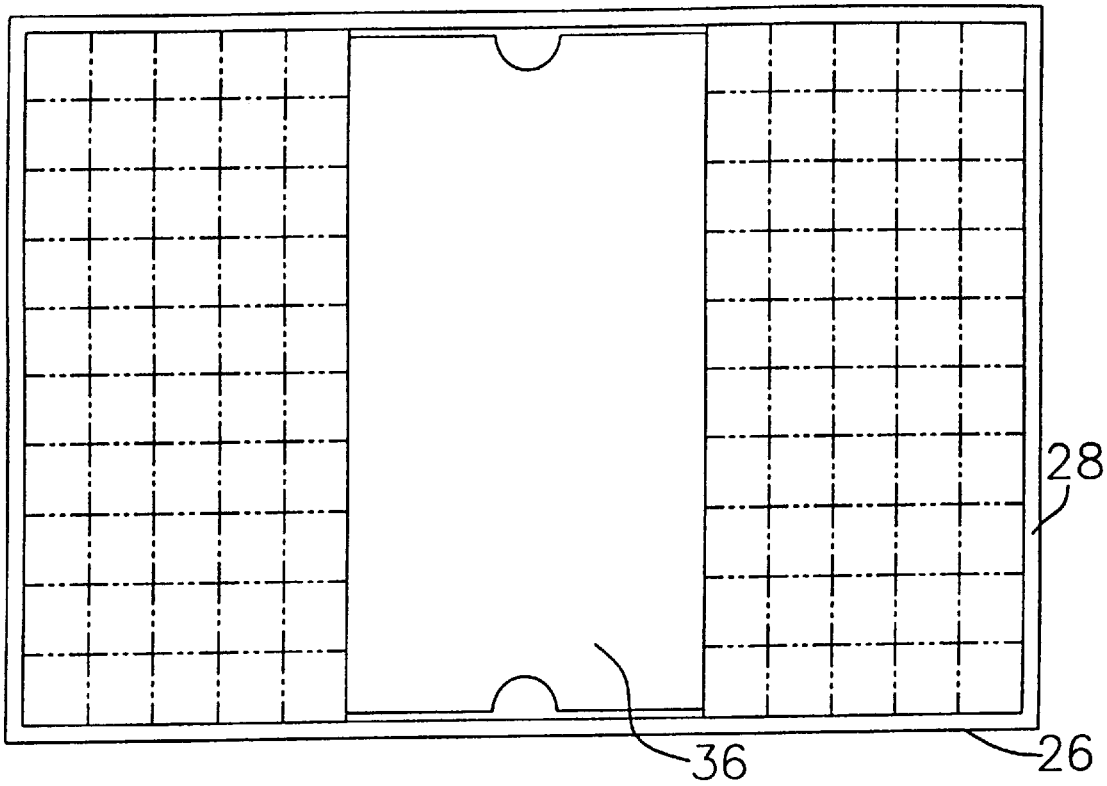
FIG. 6 is a top view of an exemplary collection tray showing the segregated tiles in phantom and the separating divider.

The collection tray of the present invention is best seen in FIG. 6 for a first rectangular embodiment. The collection tray is dimensioned to accommodate all the tiles available for game play. Additionally, in the embodiment shown in FIG. 6, sufficient lateral dimension is provided in the tray to allow segregation of the game pieces into two equal complements and a divider 36 is provided for placement between the segregated tiles to assure proper accounting of the tiles for subsequent game play and to assist in maintaining the tiles in orderly fashion for storage and transportability. For such functions, the collection tray may be placed on the game board surface, and the cover placed over the game board constraining the collection tray and tiles with the board. Alternatively, for the second embodiment of the cover shown in FIG. 5, the collection tray may be placed in the recessed portion of the cover formed by the indented top.

Random sweeping of the tiles from the collection surface of the cover into the collection tray by the game players substantially scrambles the game tiles for subsequent game play. Further dispersal of the tiles occurs during segregation of the tiles on the collection tray for accounting into complements of tiles for distribution to game players. In the embodiment shown in the drawings, two complements of tiles are segregated. Sizing of the collection tray for various games and tile configuration allows segregation of the tiles into complements for multiple players with dividers dimensioned for insertion between the segregated tiles.

The cover of the present invention, in the embodiment shown using clear plastic, also provides an attractive dust cover for the game board allowing play to be suspended with tiles in place on the board. Placement of the cover on the board precludes inadvertent jostling or misalignment of the tiles thereby allowing game play to resume at a subsequent time.

Figure 7:
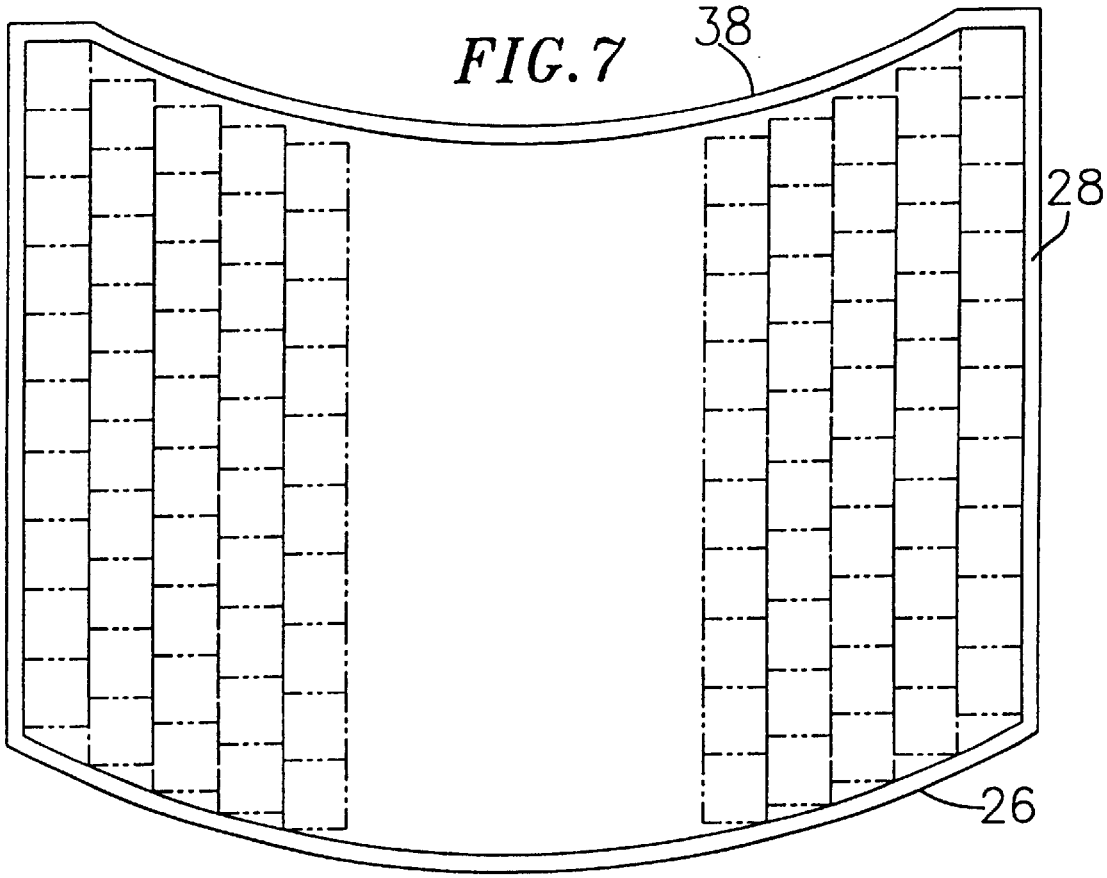
FIG. 7 is a top view of an alternate embodiment of the collection tray employing a curvilinear side for engagement with the rotary bearing of a rotatable game board.
Figure 8:
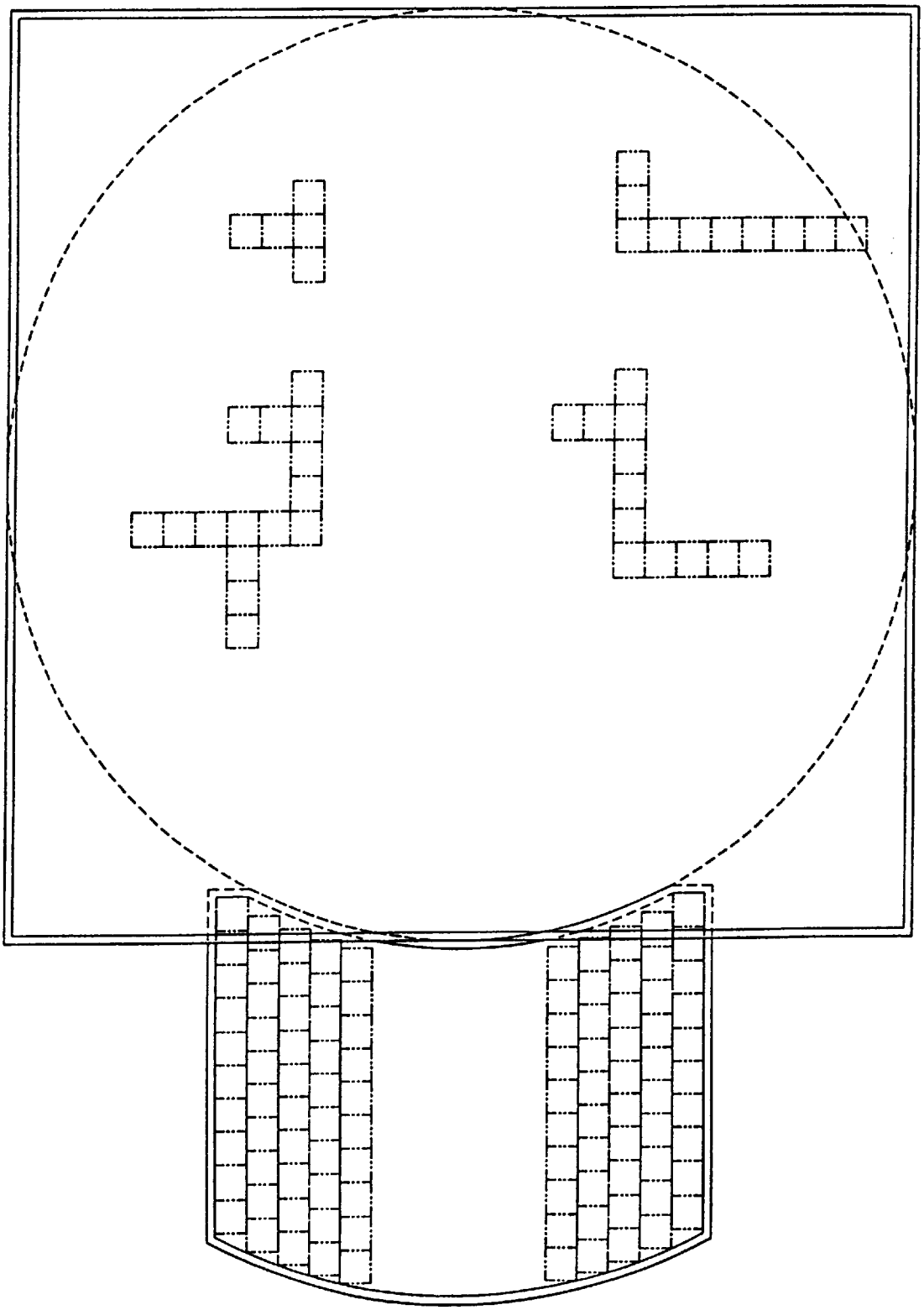
FIG. 8 is a top view of a rotatable game board showing the board in phantom to demonstrate engagement of the collection tray of FIG. 7 with the rotary bearing to provide a more stable playing combination.

Some game boards of the type described herein are provided with a rotary bearing to allow rotation of the game board for alignment with various players during game play. A second embodiment of the collection tray for the present invention is shown in FIG. 7 which incorporates at least one curved side 38 which is adapted for cooperative engagement with the circular base of game boards incorporating a rotary bearing. FIG. 8 shows a top view of such a game board with the collection tray of the embodiment shown in FIG. 7 abutting the bearing during game play. The configuration shown provides a compact arrangement on a smaller table or other playing surface with additional stability for the collection tray provided through its engagement with the bearing. The embodiment shown is particularly adapted for games in which tiles are directly selected from the collection tray for placement on the game board.

Those skilled in the art will recognize minor modifications or substitutions for various components of the invention apparatus described for the exemplary embodiment herein. Such modifications and substitutions are within the scope and intent of the present invention.

What is claimed is:

1. Apparatus adapted to collect a plurality of game pieces from a game board, the apparatus comprising:

a cover sized to fit over such game board, the cover comprising:

a collection surface; and a plurality of depending sidewalls, at least one of said sidewalls having an opening therethrough adapted to pass at least one of such game pieces, said opening including a lip flush with the collection surface; and a tray comprising a collection surface and an edge, wherein when each of the cover and the tray are placed on a level surface with their respective collection surfaces up, the collection surface of the cover is flush with the edge of the tray.

2. The apparatus of claim 1 wherein the cover is plastic.

3. The apparatus of claim 1 wherein the cover is transparent.

4. The apparatus of claim 1 wherein the cover further comprises a back surface opposite the collection surface and a plurality of ridges extending substantially normal to the back surface and along a perimeter of the back surface.

5. The apparatus of claim 4 wherein each ridge is at least as high as a greatest thickness of the collection tray.

6. The apparatus of claim 1 wherein the tray collection surface is recessed from the tray edge.

7. The apparatus of claim 1 wherein the tray edge extends along a perimeter of the tray collection surface.

8. The apparatus of claim 1 wherein the game board includes a rotatable bearing with an outer annular surface, and wherein the tray edge includes a semi-annular indentation adapted to mate with the outer annular surface of the rotatable bearing of the game board.

9. The apparatus of claim 1 wherein the tray further comprises a divider and wherein the collection surface of the tray is large enough to accommodate the divider and the plurality of game pieces.

10. Apparatus adapted to collect a plurality of game pieces from a rectangular game board, the apparatus comprising:

a cover sized to fit over such game board, the cover comprising:

a rectangular top surface comprising a ridge extending along each side of the top;

a rectangular collection surface opposite the top surface and comprising a sidewall extending along each side of the collection surface, at least one of said sidewalls comprising a cut-out portion having a lip flush with the collection surface; and a tray comprising a rectangular collection surface comprising a ridge extending along each side of the collection surface, wherein when each of the cover and the tray are placed on a level surface with the respective collection surfaces up, the collection surface of the cover is flush with the ridge of the tray.

11. The apparatus of claim 10 wherein the cover is plastic.

12. The apparatus of claim 10 wherein the cover is transparent.

13. The apparatus of claim 10 wherein the game board includes a rotatable bearing with an outer annular surface, and wherein the tray edge includes a semi-annular indentation adapted to mate with the outer annular surface of the rotatable bearing of the game board.

* * * * *